US011689843B2

(12) United States Patent
Lu et al.

(10) Patent No.: US 11,689,843 B2
(45) Date of Patent: Jun. 27, 2023

(54) EARPHONE WITH ADJUSTABLE STABILIZER

(71) Applicant: DEXIN CORP., New Taipei (TW)

(72) Inventors: Ho Lung Lu, New Taipei (TW); Ya-Hsiu Tsai, New Taipei (TW)

(73) Assignee: DEXIN CORP., New Taipei (TW)

( * ) Notice: Subject to any disclaimer, the term of this patent is extended or adjusted under 35 U.S.C. 154(b) by 46 days.

(21) Appl. No.: 17/493,347

(22) Filed: Oct. 4, 2021

(65) Prior Publication Data

US 2023/0012313 A1 Jan. 12, 2023

(30) Foreign Application Priority Data

Jul. 9, 2021 (TW) ..... 110125315

(51) Int. Cl.
*H04R 1/10* (2006.01)

(52) U.S. Cl.
CPC ..... *H04R 1/105* (2013.01); *H04R 1/1016* (2013.01); *H04R 2420/07* (2013.01)

(58) Field of Classification Search
CPC ... H04R 1/105; H04R 1/1016; H04R 2420/07
See application file for complete search history.

(56) References Cited

U.S. PATENT DOCUMENTS

2002/0021800 A1* 2/2002 Bodley ..... H04R 1/1066 379/430
2003/0002704 A1* 1/2003 Pronk ..... H04R 1/1066 381/374
2019/0116415 A1* 4/2019 Qian ..... H04R 1/105

FOREIGN PATENT DOCUMENTS

EP 1971180 A1 * 9/2008 ..... H04B 1/385

* cited by examiner

*Primary Examiner* — David L Ton
(74) *Attorney, Agent, or Firm* — Maschoff Brennan

(57) ABSTRACT

An earphone includes a main body and a stabilizer. The stabilizer is movably disposed on the main body and has a stored position and at least one sticking out position. When the stabilizer is in the stored position, the stabilizer covers part of a contour of the main body. When the stabilizer is in the at least one sticking out position, part of the stabilizer sticks out the main body and is spaced apart from the main body by a specific distance.

7 Claims, 3 Drawing Sheets

EARPHONE WITH ADJUSTABLE STABILIZER

CROSS-REFERENCE TO RELATED APPLICATIONS

This non-provisional application claims priority under 35 U.S.C. § 119(a) on Patent Application No(s). 110125315 filed in Taiwan, R.O.C. on Jul. 9, 2021, the entire contents of which are hereby incorporated by reference.

TECHNICAL FIELD

The disclosure relates to an earphone with an adjustable stabilizer.

BACKGROUND

Wireless earphones can bring a lot of conveniences as they set users free from any cables or wires. Taking the in-ear wireless earphone as an example, it is worn by inserting part of its body or an eargel attached thereon into the external ear canal, but the eargel is unable to be firmly seated in the ear by itself even if it fits the ear canal, thus the earphone is easily falling off during exercise. In the case that the earbud does not fit the ear canal, it is harder to keep the earphone staying on the ear.

For this matter, some earphones additionally have a conchal wall stabilizer or flexible hook attached thereon. However, repeated removal and installation of the stabilizer and hook easily cause damage to them, and the stabilizer and hook are separate pieces smaller than the earphone, and therefore they are easy to lose.

SUMMARY

Accordingly, the present disclosure provides an earphone with an adjustable stabilizer capable of solving the aforementioned problem.

One embodiment of the disclosure provides an earphone including a main body and a stabilizer. The stabilizer is movably disposed on the main body and has a stored position and at least one sticking out position. When the stabilizer is in the stored position, the stabilizer covers part of a contour of the main body. When the stabilizer is in the at least one sticking out position, part of the stabilizer sticks out the main body and is spaced apart from the main body by a specific distance.

According to the earphone as discussed in the above embodiment of the disclosure, since the stabilizer disposed on the main body is switchable in a position stored at the main body and at least one position sticking out the main body, the earphone can be firmly secured in the ear by the stabilizer pressing against or abutting the conchal wall, thereby preventing the earphone from falling out of the ear during general activities. Also, the stabilizer was already assembled to the main body, thus the stabilizer is less likely to be damaged or lost due to repeated removal and installation thereof.

BRIEF DESCRIPTION OF THE DRAWINGS

The present disclosure will become better understood from the detailed description given hereinbelow and the accompanying drawings which are given by way of illustration only and thus are not intending to limit the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details.

The following embodiments will be described with reference to the drawings. For the purpose of clear illustration, some conventional elements may be depicted in a simplified manner or omitted from the drawings. Also, for the same reason, one or more elements may be depicted in dotted lines. In addition, the same reference number may denote the same element or component.

Further, terms, such as "substantially" and "approximately", as used herein, relate to an industry-accepted tolerance to the corresponding term. The term "at least one" used herein may mean that the quantity of the described element is one or more than one but does not necessarily mean that the quantity is only one, unless otherwise specified. The term "and/or" may be used herein to indicate either or both of two stated possibilities. In the expression that an element is "connected", "coupled" or adhered" to another element, there may be one or more intervening elements arranged therebetween, unless otherwise specified.

Figure 1:
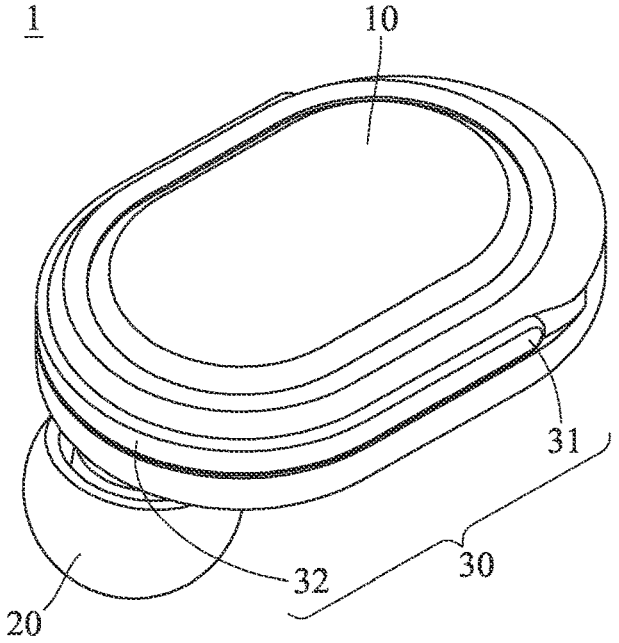
FIG. 1 is a perspective view of an earphone according to one embodiment of the disclosure.
Figure 2:
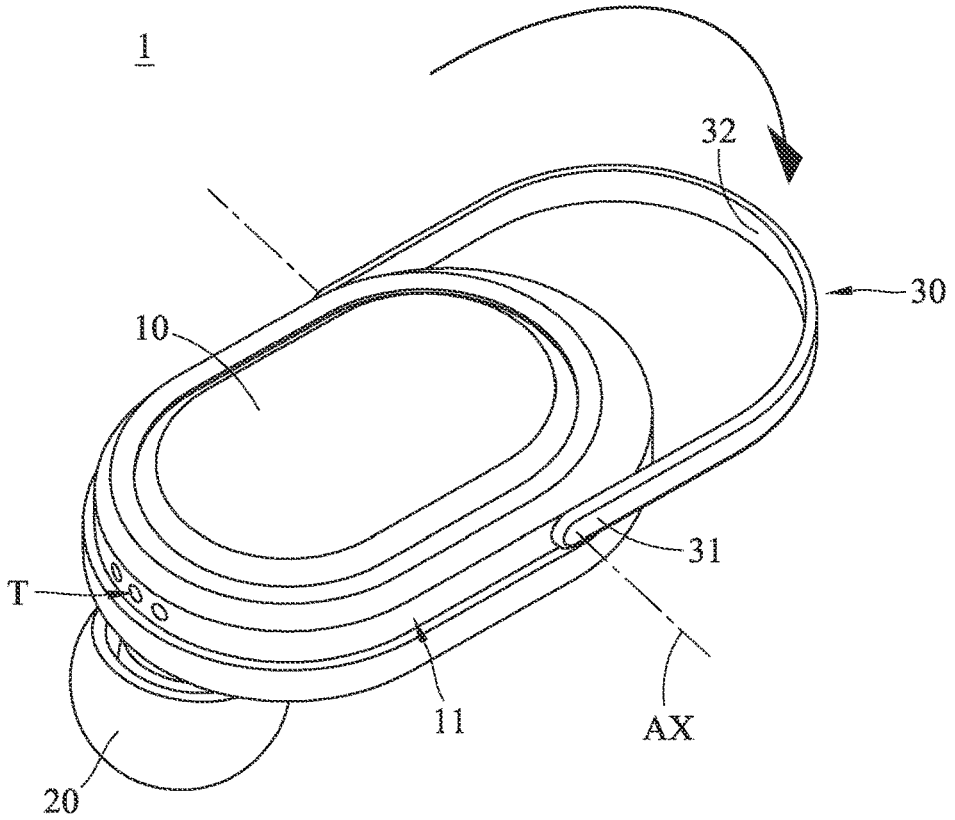
FIG. 2 is a perspective view of an earphone according to one embodiment of the disclosure when the stabilizer is in a sticking out position.

Firstly, referring to FIGS. 1-2, an earphone 1 according to one embodiment of the disclosure is provided. The earphone 1 is suitable for various requirements for activities, such as listening to music, telephone conversation, online meeting, sports, and video gaming. As shown, the earphone 1 may include a main body 10 and a stabilizer 30. In addition, in this embodiment, the earphone 1 may further include an in-ear eargel 20.

The main body 10 is, but not limited to, the right or left audio device of a true wireless stereo (TWS) Bluetooth earphone. The term "TWS" or "True wireless stereo" refers to a technology that allows two audio devices to be paired via Bluetooth, realizing the wireless separation of real Bluetooth left and right sound channels.

The in-ear eargel 20 is attached or connected to one side of the main body 10. The in-ear eargel 20 is made of, for example, silicone, sponge, urethane, or the like and is shaped and sized to be insertable in the external ear canal. Note that the shape, size, and the material of the in-ear eargel 20 all may be modified as required and are not intended to limit the disclosure. In another embodiment, the earphone may omit the in-ear eargel; in this case, part of the main body may be sized and shaped to be insertable in the external ear canal.

The stabilizer 30 may be made of any suitable plastic or metal material. The stabilizer 30 is in an arc shape that fits or matches part of the contour of the main body 10. In this embodiment, two opposite ends of the stabilizer 30 are pivotably connected to the main body 10 so that the stabilizer 30 is pivotably disposed on main body 10 and is rotatable about an axis AX with respect to the main body 10.

In this embodiment, the stabilizer 30 is switchable between a stored position (e.g., in FIG. 1) and at least one sticking out position (e.g., in FIG. 2). When the stabilizer 30 is in the stored position, the stabilizer 30 covers or may contact part of the contour at one side of the main body 10. When the stabilizer 30 is in the sticking out position, part of the stabilizer 30 sticks out another side of the main body 10 and is spaced apart from the main body 10 by a specific distance. The "specific distance" used herein may be modified as required but is not limited to be any fixed value.

In specific, in this embodiment, the stabilizer 30 is, but not limited to, integrally formed into one piece and may include two root portions 31 and a distal portion 32. The root portions 31 are pivotably disposed on two opposite sides of the main body 10 and rotatable about the axis AX with respect to the main body 10, and one of the root portions 31 is connected to the other root portion 31 via the distal portion 32; in other words, the distal portion 32 is pivotably disposed on the main body 10 via the root portions 31. As such, in FIG. 1, the stabilizer 30 is able to entirely abut part of the contour at one side of the main body 10 when in the stored position; in FIG. 2, the stabilizer 30 is able to be rotated to the sticking out position with respect to the main body 10 to make its distal portion 32 stick out and away from the other side of the main body 10.

Figure 3:
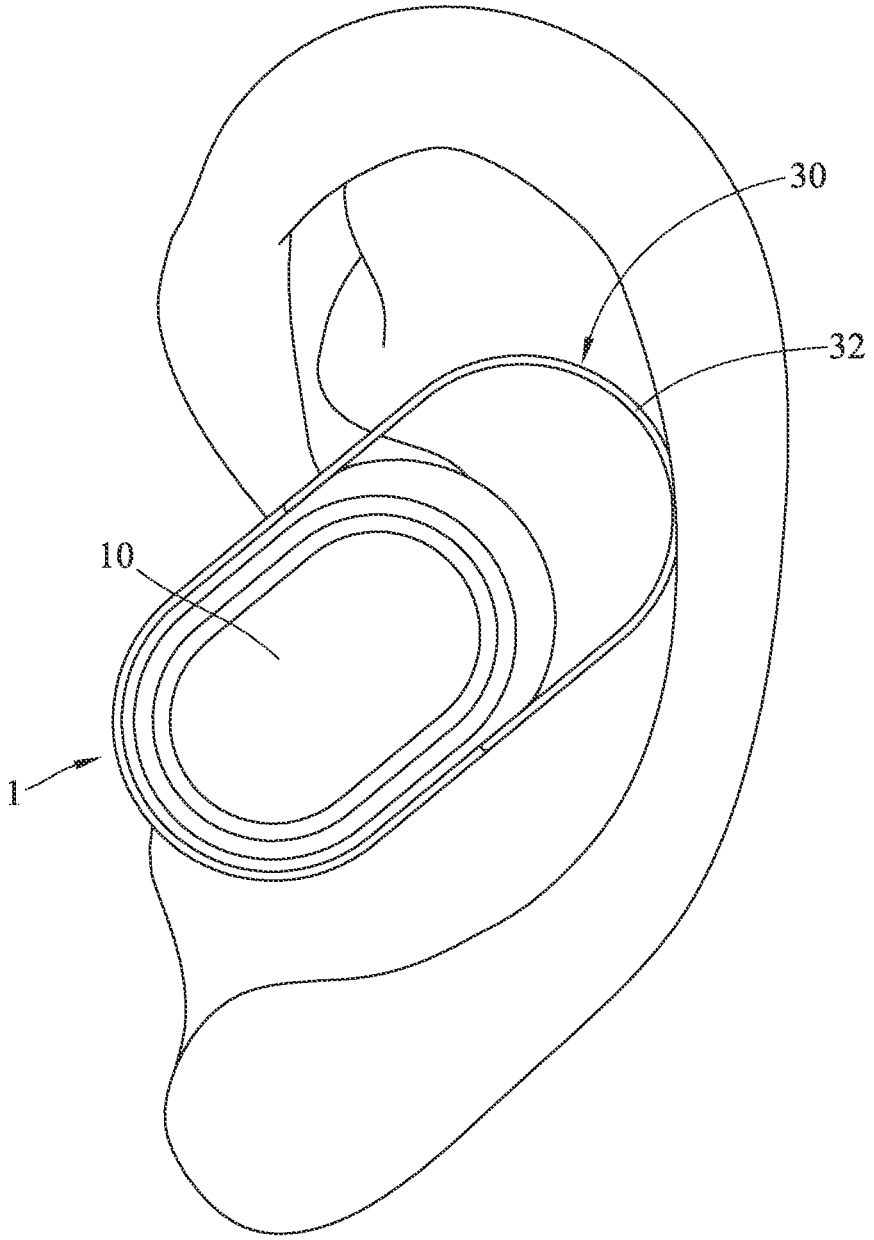
FIG. 3 depicts the operation of an earphone according to one embodiment of the disclosure.

When the stabilizer 30 is in the sticking out position, the distal portion 32 is in a position suitable to press against or abut the conchal wall, thereby stabilizing and securing the earphone 1 in the ear and preventing it from falling out of the ear. Herein, please further refer to FIG. 3, when the earphone 1 is worn by inserting the in-ear eargel 20 into the ear canal, the stabilizer 30 being switched to the sticking out position can have its distal portion 32 sticking out and away from the main body 10 to press against and abut the conchal wall. This arrangement allows the in-ear eargel 20 and the stabilizer 30 to exert force on the ear in two opposite directions, securing the earphone 1 in the ear and thereby preventing the earphone 1 from falling out of the ear during general activities. Also, the stabilizer 30 was already assembled to the main body 10, thus the stabilizer 30 is less likely to be damaged or lost due to repeated removal and installation thereof.

It is noted that the root portions 31 of the stabilizer 30 are arranged at part of the main body 10 that is offset from the center of the main body 10 so that the stabilizer 30 is able to match the contour at one side of the main body 10 when in the stored position and sticks out the other side of the main body 10 when in the sticking out position. In other words, the axis AX of the stabilizer 30 is offset from the center of the main body 10. The term "offset" used herein means that the joint between the stabilizer 30 and the main body 10 is not aligned with the center of the overall contour of the main body 10.

In addition, alternatively, any suitable mechanism (not shown) may be applied between the root portions 31 of the stabilizer 30 and the main body 10 to further stably position the stabilizer 30 in the stored position and the sticking out position.

In addition, in this embodiment, the main body 10 may have a recess 11 formed at an outer surface thereof. The recess 11 is sized and shaped to accommodate part of the stabilizer 30 when the stabilizer 30 is in the stored position. As shown in FIGS. 1 and 2, when stabilizer 30 is in the stored position, part of the stabilizer 30 is accommodated in the recess 11, such that the outer surface of the stabilizer 30 may level or slightly protrudes from the outer surface of the main body 10, without increasing the overall volume of the earphone 1 when the stabilizer 30 is in the stored position. Note that the recess 11 is optional and not intended to limit the disclosure.

Further, in this embodiment, the main body 10 has one or more terminals T exposed at one side of the outer surface thereof. The terminals T may be any suitable connectors adapted to connect an external microphone (not shown) for the earphone 1. As shown, the terminals T are arranged in the recess 11. Thus, when the earphone 1 is not equipped with any external audio device, such as an external microphone through the terminals T, the stabilizer 30 can be switched to the stored position to cover the terminals T so as to protect the terminals T from dust and water. Even when the earphone 1 is equipped with an external microphone through the terminals T to increase the overall weight, the stabilizer 30 in the sticking out position still can firmly secure the position of the earphone 1 by abutting the conchal wall, preventing the position of the earphone 1 in the ear from being affected by the additionally equipped external audio device.

Figure 4:
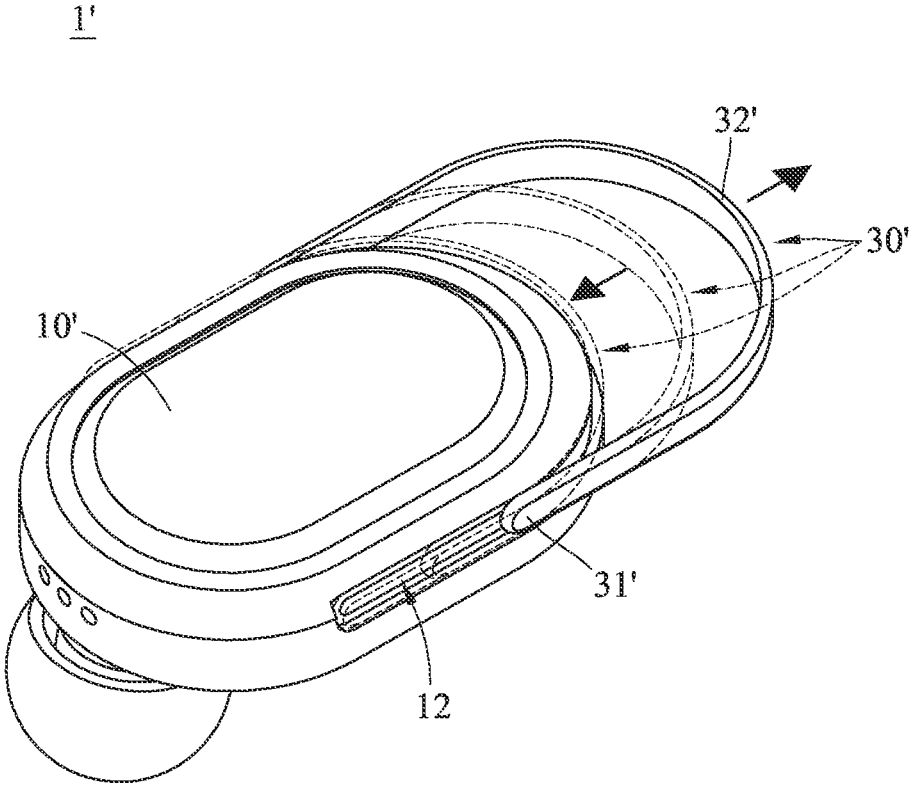
FIG. 4 is a perspective view of an earphone according to another embodiment of the disclosure.

The aforementioned embodiment is one of exemplary embodiments of the disclosure, any suitable modification or adjustment without departing from the spirit of the disclosure may be applied. For example, the stabilizer in other embodiments may be disposed on the main body in other manners. Herein, referring to FIG. 4, a perspective view of an earphone 1' according to another embodiment of the disclosure is provided, since the earphone 1' is similar to the earphone 1 in the previous embodiment, to avoid repeat illustration, only the differences between the earphone 1' and the earphone 1 will be described in detail below.

In this embodiment, a main body 10' of the earphone 1' has a groove 12, a stabilizer 30' is slidably disposed on the main body 10' along the groove 12. In such an arrangement, the stabilizer 30' is slidable between the stored position and the sticking out position with respect to the main body 10'. In addition, alternatively, any suitable mechanism (not shown) may be applied between root portions 31' of the stabilizer 30' and the groove 12 of the main body 10' to achieve a stable stepless or multi-step position adjustment of the stabilizer 30', achieving a stored position that makes stabilizer 30' match contour of the main body 10' and more than one sticking out position that allows a distal portion 32' of the stabilizer 30' to be positioned at different distance to the main body 10' and therefore allows the stabilizer 30' to fit different sizes and shapes of ear canal.

In addition, any suitable modification or adjustment without departing from the spirit of the disclosure may be applied to the stabilizer. For example, in some other embodiments, the distal portion of the stabilizer may be connected to the main body via only one root portion; in another embodiment, the stabilizer may be in another size or shape according to the contour of the main body.

According to the earphone as discussed in the above embodiments of the disclosure, since the stabilizer disposed on the main body is switchable in a position stored at the main body and at least one position sticking out the main body, the earphone can be firmly secured in the ear by the stabilizer pressing against or abutting the conchal wall, thereby preventing the earphone from falling out of the ear during general activities. Also, the stabilizer was already assembled to the main body, thus the stabilizer is less likely to be damaged or lost due to repeated removal and installation thereof.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. An earphone, comprising:

a main body;

a stabilizer, movably disposed on the main body and having a stored position and at least one sticking out position; wherein when the stabilizer is in the stored position, the stabilizer covers part of a contour of the main body; when the stabilizer is in the at least one sticking out position, part of the stabilizer sticks out the main body and is spaced apart from the main body by a specific distance; and at least one terminal exposed from an outer surface of the main body and adapted to connect an external microphone, wherein when the stabilizer is in the stored position, the stabilizer covers the at least one terminal.

2. The earphone according to claim 1, wherein the main body is a left audio device or a right audio device of a true wireless stereo Bluetooth earphone.

3. The earphone according to claim 1, wherein the stabilizer is pivotably disposed on the main body.

4. The earphone according to claim 3, wherein an axis of the stabilizer is offset from a center of the main body.

5. The earphone according to claim 1, wherein the main body has a recess, when the stabilizer is in the stored position, at least part of the stabilizer is accommodated in the recess.

6. The earphone according to claim 1, wherein the stabilizer is slidably disposed on the main body.

7. The earphone according to claim 1, further comprising an in-ear eargel attached to the main body.

* * * * *